United States Patent [19]

Liekens et al.

[11] Patent Number: 4,524,561

[45] Date of Patent: Jun. 25, 1985

[54] METHOD AND APPARATUS FOR PACKAGING SHEATHED TUBULAR STRANDS

[75] Inventors: J. Alfons F. Liekens, Olen; Ivo G. M. Hendriks, Overpelt, both of Belgium

[73] Assignee: Teepak, Inc., Oak Brook, Ill.

[21] Appl. No.: 638,817

[22] Filed: Aug. 8, 1984

Related U.S. Application Data

[62] Division of Ser. No. 331,404, Dec. 16, 1981, Pat. No. 4,484,679.

[51] Int. Cl.[3] ..... B65B 19/00; B65B 51/24; B65B 53/02

[52] U.S. Cl. ..... 53/397; 53/204; 53/285; 53/409; 53/442; 53/479; 53/557; 53/585; 156/69; 156/86; 156/294; 156/443

[58] Field of Search ..... 53/204, 285, 379, 397, 53/399, 409, 442, 463, 477, 479, 557, 580, 581, 585; 156/69, 86, 198, 294, 423, 443, 468, 475, 499; 206/303, 802

[56] References Cited

U.S. PATENT DOCUMENTS

| | | | |
|---|---|---|---|
| 2,878,628 | 3/1959 | Curry | 53/442 X |
| 4,033,382 | 7/1977 | Eichin | 138/121 X |
| 4,263,942 | 4/1981 | Lenhart et al. | |

FOREIGN PATENT DOCUMENTS 2809585 0/1979 Fed. Rep. of Germany

*Primary Examiner*—Paul A. Bell
*Assistant Examiner*—Michael D. Folkerts
*Attorney, Agent, or Firm*—Michael L. Dunn; Howard M. Ellis

[57] ABSTRACT

This relates to method and apparatus for the packaging of a tubular shirred casing strand within a wrap sleeve. The wrap sleeve is provided with end portions which extend beyond the casing strand, and these end portions are heated and folded and deformed by way of a plunger which functions as a piston within a mold structure so as to define a rigid substantially solid end cap which is integral with the wrap sleeve.

11 Claims, 7 Drawing Figures

METHOD AND APPARATUS FOR PACKAGING SHEATHED TUBULAR STRANDS

This is a division of application Ser. No. 331,404, filed Dec. 16, 1981, and now U.S. Pat. No. 4,484,679.

This invention relates in general to new and useful improvements in compressed shirred casing strands and more specifically to the packaging of such strands.

Shirred casing strands have been packaged within a suitable wrap so as to prevent their elongation during shipment, handling and, where required, soaking or lubrication. The compressed shirred casing strands are generally wrapped in a sleeve which may be in the form of a film or suitable netting. The ends of the sleeve are made secure relative to the ends of the casing strand in a manner wherein the casing material may be readily placed upon the usual filling horn and the casing drawn out of the wrap.

This invention has to do with the specific formation of the end portions of the wrapping sleeve so as to form rigid end caps which engage the opposite ends of the casing strand so as to maintain the compressed state of the strand while at the same time permitting the strand to be readily mounted on a filling horn and the strand readily drawn out of the end cap.

In accordance with this invention, the necessary wrap sleeve is provided with elongated end portions which extend beyond the ends of the casing strand. These end portions are heated within an annular or cylindrical mold and, once the end portions have been heated to a workable temperature, a plunger moves axially within the mold folding and pushing the sleeve end portions toward the adjacent ends of the casing strand with the sleeve end portions being generally fluid and being bondable together to define rigid end caps which have sufficient strength to prevent opening or elongation of the casing strand.

Suitable apparatus for heating and forming the end portions of the wrap sleeve is also provided.

With the above and other objects in view that will hereinafter appear, the nature of the invention will be more clearly understood by reference to the following detailed description, the appended claims, and the several views illustrated in the accompanying drawings.

Figure 1:
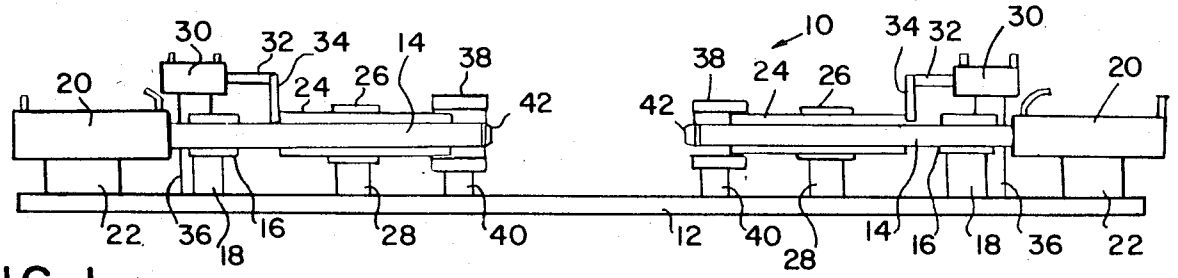
FIG. 1 is a schematic elevational view with parts shown in section of apparatus for packaging a tubular casing strand in accordance with this invention.

Referring now to FIG. 1, there is illustrated a wrap forming apparatus generally identified by the numeral 10. The apparatus 10 includes a suitable base or support 12 which carries the various components of the apparatus.

The apparatus 10 includes a pair of opposed elongated supports 14 which also function as inner mold members in a manner to be described hereinafter. The supports 14 are mounted for axial movement by means of support sleeves 16 which are supported from the base 12 by uprights 18. Each support 14 is connected to or is an extension of a piston rod of a double acting cylinder 20 which is suitably mounted on the support 12 by means of an upright 22.

A tubular or cylindrical plunger 24 surrounds the support or inner mold member 14 and is guidedly mounted within a guide sleeve 26 for axial movement. Each guide sleeve 26 is fixedly mounted relative to the support 12 by means of an upright 28.

In order that the plunger 24 may be selectively advanced and retracted, there is provided for each plunger 24 a double acting fluid cylinder 30 having a piston rod 32 which is connected to a remote end of the plunger 26 by means of a fitting 34. Each cylinder 30 is supported from the base 12 by way of an upright 36.

Finally, there is a pair of axially spaced heating jackets 38 which also define outer mold members. Each heating jacket 38 is supported in concentric relation with respect to a respective support or inner mold member 14 and a respective plunger 24 by an upright 40.

It is preferred that the free opposed ends of the supports or inner mold members 14 be tapered as at 42 so that the supports 14 may enter the ends of a casing strand to be wrapped in wedging relation as will be described in detail hereinafter.

Figure 2:
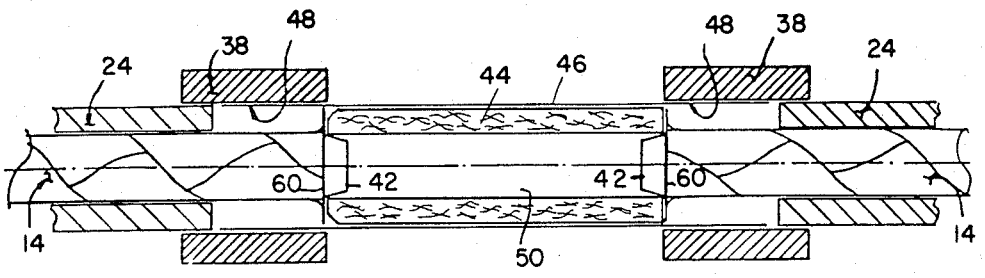
FIGS. 2, 3 and 4 are enlarged schematic elevational views with parts in section showing the manner in which the apparatus of FIG. 1 is utilized in the packaging of a casing strand and forming end caps on the wrap.

With reference to FIG. 2, it will be seen that the heating jackets 38 are spaced apart a distance substantially equal to the length of an associated casing strand 44. This spacing permits a casing strand 44 to be inserted between the heating jackets 38 and, when the wrapping thereof is completed, to be removed therefrom.

In accordance with this invention, the casing strand 44 is telescoped within a wrap member 46 in the form of an elongated sleeve of a length much greater than the length of the casing strand so as to have end portions 48 which extend beyond the ends of the casing strand 44. The wrap 46 may be either in the form of a suitable plastic film or in the form of a suitable plastic netting.

With the casing strand 44 and the wrap sleeve 46 positioned relative to the heating jackets 38 as shown in FIG. 2, the supports 14 are advanced so that the tapered ends 42 thereof enter into the ends of the casing strand 44 and wedgedly engage the same so as rigidly to support the casing strand. It is to be noted that each support 14 is circular in cross section and is of a diameter slightly greater than the diameter of the opening 50 defined by each casing strand 44.

With the casing strand and the wrap sleeve 46 supported as shown in FIG. 2, the heating jackets 38 are energized so as to heat the end portions 48. As the end portions 48 of the wrap sleeve 46 are heated, the material of the wrap sleeve begins to soften and possibly shrink so as to deflect radially inwardly toward the supports 14. At this time the plungers 24 move together to engage the end portions 48 and serve to fold and gather the end portions with the heating jackets 38 and the supports 14 cooperating to define an annular or cylindrical mold cavity 52 which remains of a constant cross section but which gradually decreases in axial extent as the plungers 24 move together.

Figure 3:
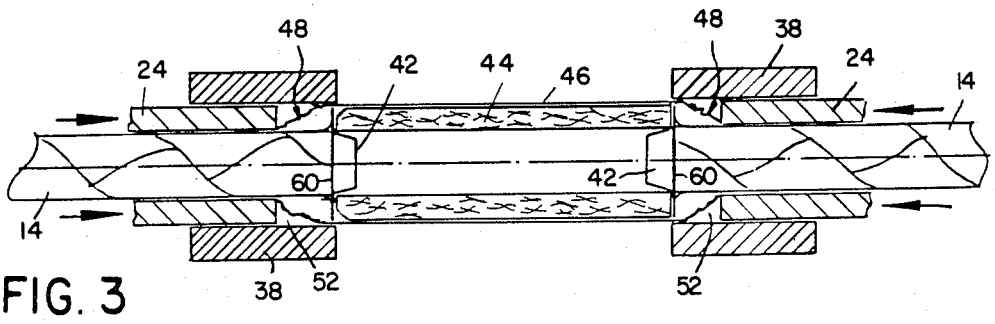
Figure 4:
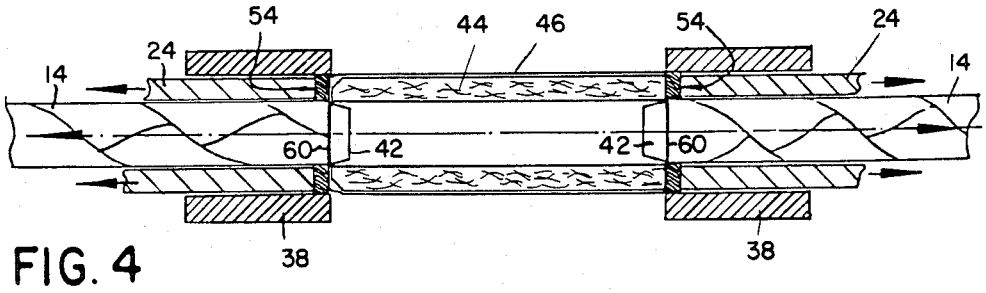

It is to be understood that the end portions 48 are heated to such an extent that molding of the folded and gathered together end portion 48 is readily effected by the plungers 24 and all contiguous portions of the end portions 48 become bonded together even though the wrap material may not become molten. The net result is the transforming of the tubular end portions 48 into short compact rigid end caps 54 as is best shown in FIG. 4. These end caps 54, while remaining integrally connected to the central portion of the wrap sleeve 46, are compressively engaged with the ends of the casing strand 44. The formed end caps 54 are free to cool after the heating jackets are no longer heated and become solidified. At this time the plungers 24 and the supports 14 may be retracted, as shown in FIG. 3, thereby releasing the wrapped strand.

Figure 5:
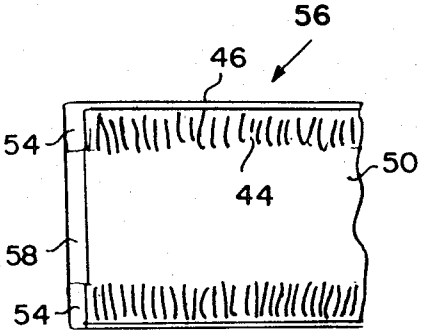
FIG. 5 is an enlarged fragmentary sectional view showing one end of a casing strand wrapped in accordance with this invention.

Referring now to FIG. 5, it will be seen that the end portion of a wrapped strand unit, generally identified by the numeral 56, is illustrated. It will be seen that the wrap sleeve 46 generally confines the shirred casing of the casing strand 44 and serves as a tension member between the end caps 54 which are very rigid members and which hold the casing strand material in compressed relation. It is also to be noted that since the end caps 54 are formed within a mold defined on the inside by a support 14 and on the outside by an associated heating jacket 38, the annular cross section of the end cap 54 is assured and its relationship to the tubular casing strand 44 is also assured. Most specifically, the end cap 54 has an opening 58 therethrough which is aligned with the opening 50 of the casing strand 44, but may be slightly larger in diameter. This facilitates the pushing of the wrapped strand unit 56 on the usual filling horn and the withdrawal of the casing material over the horn and through the associated end cap 54.

Figure 6:
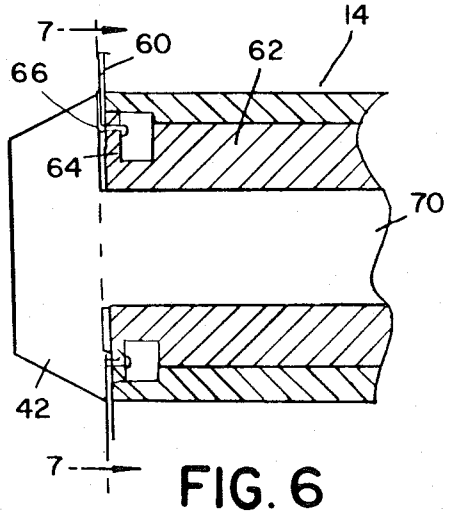
FIG. 6 is an enlarged fragmentary sectional view taken through an end portion of one of the supports, and shows the general details of the mounting of mold forming blades thereon.
Figure 7:
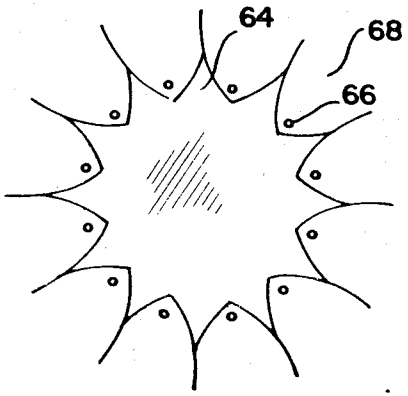
FIG. 7, is a fragmentary transverse sectional view taken generally along the line 7—7 of FIG. 6, and shows the general mounting of the segments which form one of the blades.

Under certain conditions it may be desirable not to directly form the end caps against the ends of the casing strand. Accordingly, as is best shown in FIGS. 6 and 7, there is carried by an end portion of each of the supports 14 a radially expansible-retractable annular mold forming blade 60. The blade 60, as is clearly shown in FIGS. 2, 3 and 4, in its expanded state is disposed at opposite ends of the casing strand 44 and the end caps 54 are molded thereagainst by the action of the plungers 24. In this manner, the hot and flowable plastic material of the wrap is not brought into direct contact with the casing strand and damage to the casing strand is prevented while at the same time eliminating any possibility of the end caps 54 bonding to the casing strand.

It is to be understood that the mold forming blade 60 is to be retracted radially within the outline of the support 14. To this end, the support 14 is of a tubular construction as shown in FIG. 6, and has rotatably journalled within a sleeve 62 which is provided at its extreme end with a radially outwardly projecting annular mounting flange 64. The mounting flange 64 has pivotally connected thereto by means of fasteners 66 individual blade segments 68 of a configuration best shown in FIG. 7. It is to be understood that the sleeve 62 is rotatable and the blade segments 68 are so guided with respect to the tubular support 14 that, when the annular flange 64 is rotated, the blade segments 68 will pivot and generally follow the annular flange 64 so as to be retracted within the outline of the support 14.

It is to be understood that the sleeve 62 may be rotated within the support 14 in any desired manner.

In view of the fact that the blade 60 may be of any selected conventional construction and the constructional details of the blade 60 which permit the radial retraction thereof forms no part of this invention, no further details of the mounting of the blade 60 will be set forth hereinafter.

It is also to be noted that the tapered ends 42 of the supports 14 are separately formed from the supports and are carried by an inner shaft 70. The tapered ends 42 are spaced from and are generally opposed to the adjacent ends of the supports 14 so as further to aid in the guiding of the blade segments 68 between expanded and retracted positions.

Although only a preferred embodiment of the wrapped casing strand unit and the apparatus for forming the same have been specifically illustrated and described herein, it is to be understood that minor variations may be made therein without departing from the spirit and scope of the invention as defined by the appended claims.

We claim:

1. An apparatus for securing a tubular wrap to a compressed casing strand, said apparatus comprising a pair of axially spaced aligned heating jackets, said jackets being spaced apart a distance substantially equal to the length of the intended casing strand to be wrapped and having axial internal openings of a cross section greater than that of the intended casing strand, opposed supports extending through said jackets for internally engaging opposite ends of the intended casing strand, said jacket and said support at each end of said apparatus defining an annular mold, and an annular plunger movable between said jacket and said support of each mold for folding and compressing heated excess wrap material at each end of an intended casing strand for forming thick annular end caps on a wrap.

2. An apparatus according to claim 1 together with means for reciprocating said plungers.

3. An apparatus according to claim 1 together with means for withdrawing at least one of said supports to permit the positioning of a casing strand having a wrap sleeve telescoped thereover.

4. An apparatus according to claim 1 wherein each of said supports has means for radially outwardly expanding ends of a casing strand positioned therebetween.

5. An apparatus according to claim 1 wherein each of said supports has a tapered end portion for radially outwardly expanding ends of a casing strand positioned therebetween.

6. An apparatus according to claim 1 wherein each of said supports carries a radially expandable blade for positioning at opposite ends of a casing strand being wrapped, said blades in their expanded state being axially aligned with said respective ones of said annular plungers to form opposing wall surfaces.

7. A method of wrapping a compressed casing strand, said method comprising the steps of telescoping a tubular wrap over a casing strand with the wrap having end portions extending beyond ends of the casing strand, supporting the so wrapped casing strands at opposite ends thereof by opposed supports partially entering ends of the casing strand and defining inner mold members, heating the wrap end portions to effect an initial shrinkage of the wrap end portions in a radially inward direction, and then axially compressing and folding the heated wrap end portions towards ends of the casing strands and about said inner mold members to define rigid end caps at the ends of the casing strand integral with the tubular wrap.

8. A method according to claim 7 wherein said heating is effected by outer mold members cooperating with the inner mold members to define said rigid end caps.

9. A method according to claim 8 wherein said compressing and folding is effected by annular plungers moving axially between said inner and outer mold members.

10. A method according to claim 9 together with the step of inserting an annular mold forming blade at each end of said casing in alignment with said annular plunger, and forming said rigid end caps against said blades 11. A method according to claim 10 wherein said blades are retracted prior to the releasing of a wrapped strand.

* * * * *